US005873245A

United States Patent [19]

Kato et al.

[11] Patent Number: 5,873,245

[45] Date of Patent: Feb. 23, 1999

[54] HYDRAULIC DRIVE SYSTEM

[75] Inventors: Hideyo Kato, Ibaraki-ken; Masami Ochiai, Atsugi, both of Japan

[73] Assignee: Hitachi Construction Machinery Co., Ltd., Tokyo, Japan

[21] Appl. No.: 809,048

[22] PCT Filed: Jul. 8, 1996

[86] PCT No.: PCT/JP96/01888

§ 371 Date: Mar. 7, 1997

§ 102(e) Date: Mar. 7, 1997

[87] PCT Pub. No.: WO97/03292

PCT Pub. Date: Jan. 30, 1997

[30] Foreign Application Priority Data

Jul. 10, 1995 [JP] Japan ..... 7-173708

[51] Int. Cl.[6] ..... F15B 11/16

[52] U.S. Cl. ..... 60/445; 60/452

[58] Field of Search ..... 60/445, 452; 91/447

[56] References Cited

U.S. PATENT DOCUMENTS

| | | | |
|---|---|---|---|
| 5,134,853 | 8/1992 | Hirata et al. | 60/452 |
| 5,394,697 | 3/1995 | Hirata | 60/452 |
| 5,528,911 | 6/1996 | Roth et al. | 60/452 |
| 5,571,226 | 11/1996 | Kobayashi | 60/452 |

FOREIGN PATENT DOCUMENTS

| | | |
|---|---|---|
| 60-201102 | 10/1985 | Japan . |
| 1-312201 | 12/1989 | Japan . |
| 3-157503 | 7/1991 | Japan . |
| 3-213703 | 9/1991 | Japan . |
| 4-19406 | 1/1992 | Japan . |
| 7-63203 | 3/1995 | Japan . |

*Primary Examiner*—Sheldon J. Richter

*Attorney, Agent, or Firm*—Fay, Sharpe, Beall, Fagan, Minnich & McKee

[57] ABSTRACT

Pressure adjusting valves (9A, 9B) control outlet pressures of variable throttle portions (**8*a*) of directional control valves (8A, 8B) of closed center type to be kept substantially equal to a maximum load pressure detected by a detecting line (13). A variable throttle valve (40) and a pressure adjusting valve (41) are disposed in a bypass line (5) branched from a pump supply line (3) for controlling an outlet pressure of the variable throttle valve (40) to be also kept substantially equal to the maximum load pressure. The variable throttle valve (40) has an opening area controlled to be reduced with an increase in the input amount by which a control lever unit is operated, and a pump delivery rate is controlled by a tilting control device (2*n***) to become a flow rate corresponding to the input amount of the control lever unit.

16 Claims, 11 Drawing Sheets

HYDRAULIC DRIVE SYSTEM

TECHNICAL FILED

The present invention relates to a hydraulic drive system equipped on hydraulic machines such as hydraulic excavators and cranes.

BACKGROUND ART

Known hydraulic drive systems equipped on hydraulic machines such as hydraulic excavators and cranes are described in, e.g., JP-A-3-213703, JP-A-7-63203 and JP-A-1-312201.

The hydraulic drive system described in JP-A-3-213703 comprises a variable displacement hydraulic pump, directional control valves of center bypass type for controlling flows of a hydraulic fluid supplied to a plurality of actuators from the hydraulic pump, and a pump control device for controlling the delivery rate of the hydraulic pump to become a flow rate corresponding to shift amounts by which the directional control valves are operated. The directional control valves of center bypass type include each a throttle (center bypass throttle) in its center bypass passage. Downstream of the center bypass throttle, there is provided a pressure compensating valve for controlling the differential pressure across the center bypass throttle to be kept constant.

The hydraulic drive system described in JP-A-7-63203 comprises a variable displacement hydraulic pump, a plurality of actuators driven by a hydraulic fluid delivered from the hydraulic pump, a plurality of directional control valves of closed center type for controlling flows of the hydraulic fluid supplied to the plurality of actuators, a plurality of control lever units for operating the plurality of directional control valves, a bypass line connected to a delivery line of the hydraulic pump, a bleed valve disposed in the bypass line and returning the hydraulic fluid delivered from the hydraulic pump to a reservoir when the plurality of directional control valves are in their neutral positions, and a bleed control device for controlling the bleed valve so that the bleed valve has an opening corresponding to input amounts by which the plurality of control lever units are operated.

The hydraulic drive system described in JP-A-1-312201 is constructed as shown in FIG. 15.

In FIG. 15, a valve apparatus comprising pressure compensating valves 82A, 82B, variable throttle valves 80A, 80B of closed center type, and directional control valves 81A, 81B is connected to a supply line 3 of a hydraulic fluid delivered from a variable displacement pump 1. Actuators 6, 7 are connected respectively to the directional control valves 81A, 81B through load lines 81A*a*, 81A*b* and load lines 81B*a*, 81B*b*. Also, the variable throttle valves 80A, 80B and the directional control valves 81A, 81B are driven for operation by respective pilot pressures produced by control lever units 30A, 30B.

Lines 83A, 83B for detecting load pressures of the associated actuators are connected respectively to lines interconnecting the variable throttle valves 80A, 80B and the directional control valves 81A, 81B. The detected load pressures are introduced as control signals to the pressure compensating valves 82A, 82B, and the detecting lines 83A, 83B are connected to a shuttle valve 84. Maximum one of the load pressures of the actuators 6, 7 driven by the hydraulic pump 1 is detected through the shuttle valve 84 and introduced to a maximum load pressure detecting line 85*b*.

Further, in a bypass line 5 branched from the supply line 3 of the hydraulic pump 1, there are disposed an unloading valve 85 to which the delivery pressure of the hydraulic pump 1 and the detected maximum load pressure are introduced respectively through signal lines 85*a*, 85*b* and which drains a part of the flow delivered from the hydraulic pump 1 when the differential pressure between the pump delivery pressure and the maximum load pressure exceeds the pressure difference preset by a spring 85*s*, and a pressure generator, downstream of the unloading valve 85, comprising a throttle 42 and a relief valve 43. A pressure generated by the pressure generator is introduced to a tilting control device 2*n* of the hydraulic pump 1 through a signal line 44 to carry out negative flow control under in such a manner that the delivery rate of the hydraulic pump 1 is decreased or increased in accordance with an increase or decrease of the pressure generated by the pressure generator depending on an increase or decrease of the amount by which the hydraulic fluid is drained through the unloading valve 85.

DISCLOSURE OF THE INVENTION

The conventional hydraulic drive systems described above have, however, problems below.

Generally, in a circuit using a directional control valve of center bypass type including a center bypass throttle, because the center bypass throttle of the directional control valve is throttled so as to provide an opening corresponding to the input amount of the control lever unit, the so-called bleed control is possible such that when an actuator is started up, the actuator is driven while a part of the flow delivered from the hydraulic pump 1 is bled. This provides a good operation feeling with no shock given to the actuator. But such a circuit has basic problems described below.

(1) In the case of employing a plurality of directional control valves of center bypass type, the directional control valves are connected in tandem or parallel with respect to the hydraulic pump. When a plurality of actuators are simultaneously operated to perform the combined operation, a hydraulic fluid is preferentially supplied to the actuator on the upstream side in a tandem circuit, and to the actuator on the lower pressure side in a parallel circuit. Anyway, satisfactory maneuverability cannot be achieved in the combined operation.

(2) Because the flow rate of the hydraulic fluid passing through the center bypass throttle varies depending on the load pressure, a metering characteristic of an inflow variable throttle, particularly a metering characteristic in rise, is changed depending on the load pressure. More specifically, in the case of the actuator being driven under the bleed control through the center bypass throttler if the pump delivery pressure is raised with an increase of the load pressure, the flow rate of the hydraulic fluid passing through the center bypass throttle is increased even with the input amount of the control lever unit kept fixed and the opening of a bleed valve also kept fixed. Therefore, when the load pressure is low, the pump delivery pressure exceeds the load pressure at a certain input amount of the control lever unit, enabling the hydraulic fluid to be supplied to the actuator. But when the load pressure becomes high, there occurs a phenomenon that the pump delivery pressure does not exceed the load pressure at the same input amount of the control lever unit as in the above case, and the hydraulic fluid can be supplied to the actuator only when the input amount of the control lever unit is further increased to further restrict the opening of the center bypass throttle. Accordingly, as the load pressure increases, a dead zone is relatively enlarged in the input amount of the control lever unit and an effective stroke range where the control lever unit can control a meter-in flow rate is narrowed, thus resulting in deterioration of maneuverability.

In the hydraulic drive system described in JP-A-3-213703, since the differential pressure across the bleed valve is controlled to be kept constant by the pressure compensating valve, the flow rate of the hydraulic fluid passing through the center bypass throttle is prevented from increasing even with an increase of the actuator load pressure, and load compensation of ensuring the flow rate of the hydraulic fluid supplied to the actuator is achieved. Therefore, the above problem (2) is solved to some extent. But since the directional control valves of center bypass type are employed, the above problem (1) cannot be solved and maneuverability in the combined operation remains problematic.

On the other hand, generally, in a circuit using a plurality of directional control valves of closed center type, maneuverability in the combined operation can be ensured by providing pressure compensating valves to control differential pressures across the directional control valves. Also, the pressure compensating valve prevents change in metering characteristic of an inflow variable throttle depending on the load pressure and provides a fixed metering characteristic regardless of the load pressure. Therefore, the above-mentioned problems (1) and (2) experienced in the circuit using directional control valves of center bypass type are avoided. But, because of using directional control valves of closed center type, when an actuator is started up, the bleed control under which the actuator is driven while a part of the flow delivered from a hydraulic pump is bled cannot be effected and a good operation feeling with no shock given to the actuator cannot be achieved.

In the hydraulic drive system described in JP-A-7-63203, since the bleed valve is disposed in the bypass line and controlled so that the bleed valve has an opening corresponding to input amounts by which the control lever units are operated, the bleed valve effects the same function as the center bypass throttle. Therefore, satisfactory maneuverability is obtained with an operation feeling comparable to the bleed control provided by the directional control valves of center bypass type including the center bypass throttles, in spite of using closed center type valves as the directional control valves. Because of the bleed valve disposed in the bypass line, however, the flow rate of the hydraulic fluid passing through the bleed valve is changed depending on the load pressure and the metering characteristic of the inflow variable throttle is changed depending on the load pressure. This raises a problem similar to the above (2) in the circuit using the directional control valves of center bypass type.

In the hydraulic drive system described in JP-A-1-312201, since the unloading valve 85 is disposed in the bypass line 5 and the delivery rate of the hydraulic pump 1 is subjected to the negative flow control so that the differential pressure between the pump delivery pressure and the maximum load pressure is held at a predetermined constant value, rises of inflow rates (metering) to the actuators 6, 7 with respect to strokes of the variable throttle valves 80A, 80B of the valve apparatus can be made fixed regardless of the load pressure and a good flow rate characteristic is achieved. In addition, because of the valve apparatus including the pressure compensating valves 82A, 82B, when the plural hydraulic actuators 6, 7 connected in parallel are driven by the one variable displacement hydraulic pump 1, those actuators can be operated independently of each other. But, since the variable throttle valves 80A, 80B of closed center type are employed and the unloading valve disposed in the bypass line 5 has not such a bleed control function as provided by the directional control valves of center bypass type, the bleed control under which an actuator is driven while a part of the flow delivered from a hydraulic pump is bled cannot be effected when the actuator 6 or 7 is started up.

Further, the hydraulic drive systems described in JP-A-3-213703 and JP-A-1-312201 give rise to problems below when an inertial load is driven.

In the hydraulic drive systems described in JP-A-3-213703, since the pressure compensating valve is provided in association with the center bypass valve for purposes of load compensation, the pump delivery pressure is so raised as to be relieved through a relief valve, unless a flow rate resulted from subtracting the bleed flow rate from the delivery rate of the hydraulic pump is all absorbed by the actuator, for example, as encountered when an inertial load is driven. This leads to an excessive pressure rise and an energy loss. Another problem is that such a pressure rise may cause the inertial load to move abruptly, making it difficult to smoothly drive the inertial load.

In the hydraulic drive system described in JP-A-1-312201, when the actuator 6 is driven which is employed as a swing motor for turning an upper structure, having a front working device, of a hydraulic excavator or a track motor for traveling a body of the excavator, a great inertial load causes the unloading valve 85 to be closed upon receiving a detected maximum load pressure even with slight manipulation of the control lever unit by an operator. Therefore, almost no hydraulic fluid is drained through the unloading valve 85 and the pump delivery pressure is raised in a moment to the relief pressure of a relief valve (not shown) for restricting the highest pressure. Thus, even if the operate slightly manipulates the control lever unit with intent to gently and smoothly drive the actuator, the driving pressure reaches a level higher than necessary and starts up the actuator with a shock. In other words, the actuator cannot be driven to smoothly start up by degrees.

Further, work of loading earth and sand taken up with a bucket onto a dump track, for example, is performed by the combined operation in which a boom of the front working device is raised and, at the same time, the upper structure including the front working device is turned. In this case, if the actuator 6 is employed as a swing motor and the actuator 7 is employed as a boom cylinder, a large swing load due to great inertia is detected as the maximum load pressure and the unloading valve 85 in the bypass line 5 is fully closed. Accordingly, on the swing motor side subjected to great inertia, the load pressure is so increased at the start-up that the hydraulic fluid under high pressure supplied from the hydraulic pump 1 is drained through a safety valve (not shown) disposed in the load line (81A*a* or 81A*b*), and the hydraulic power is wasted. This loss of the hydraulic power lowers the boom-up speed. On the boom side subjected to a small load, since the pressure compensating valve 82B restricts the line under the pressure compensating control, heat is generated and wastefully dissipated. This energy loss due to restriction further lowers the boom-up speed. Moreover, the hydraulic pump 1 is generally equipped with a tilting control device (not shown) for horsepower limitation control which controls the pump delivery rate for purposes of protecting a drive source of the hydraulic pump so that a pump output is held fixed (i.e., $P \cdot Q = C$ where P is the delivery pressure, Q is the delivery rate, and C is a constant (horsepower)). Therefore, when the pump delivery pressure is raised to the relief pressure of the swing safety valve, the pump delivery rate is reduced conversely and this reduction in the pump delivery rate still further lowers the boom-up speed. Consequently, the operator cannot smoothly perform the loading work as a result of quick speed-up of the upper structure and a low speed of the boom.

In addition, the hydraulic drive system described in JP-A-1-312201 has another problem below.

Hydraulic excavators are required to have a function of driving an actuator at a very low speed (fine control) in leveling work or the like. In this case, because the horsepower absorbed by the hydraulic pump 1 is small, it is customary to set a prime mover (engine revolution speed) as the drive source of the hydraulic pump to a low speed so that the inflow rate to the actuator is reduced and the amount of fuel consumed by an engine is also reduced. In the hydraulic drive system described in JP-A-1-312201, however, since the inflow rate to the actuator is ensured in accordance with the pressure difference preset by the spring 85*s* of the unloading valve 85, the actuator speed cannot be changed depending on the low or high speed of the prime mover, as indicated by a dot line in FIG. 7. Furthermore, since the delivery rate of the hydraulic pump 1 is increased or decreased under negative flow control with the unloading valve operating so as to ensure a certain differential pressure, the inflow rate to the actuator is saturated at a lower value as the engine revolution speed reduces. Accordingly, an effective stroke range responsible to a command from the operator is narrowed and the fine control function intended by the operator cannot be achieved.

A first object of the present invention is to provide a hydraulic drive system which can perform bleed control in a circuit using directional control valves of closed center type, and also can lessen the effect of a load pressure upon a metering characteristic of an inflow variable throttle.

A second object of the present invention is to provide a hydraulic drive system which can lessen the effect of a load pressure upon a metering characteristic of an inflow variable throttle, and also can improve operability of an actuator with a heavy load.

A third object of the present invention is to provide a hydraulic drive system which can lessen the effect of a load pressure upon a metering characteristic of an inflow variable throttle, and also can increase or decrease the inflow rate to an actuator depending on an engine revolution speed, thereby ensuring a satisfactory fine control function.

To achieve the above objects, according to the present invention, in a hydraulic drive system comprising a variable displacement hydraulic pump, a plurality of actuators driven by a hydraulic fluid delivered from the hydraulic pump, a plurality of directional control valves of closed center type connected to the hydraulic pump through hydraulic fluid supply lines for controlling flows of the hydraulic fluid supplied to the plurality of actuators, a plurality of control lever units for operating the plurality of directional control valves, and pump control means for controlling a delivery rate of the hydraulic pump to become a flow rate corresponding to input amounts by which the plurality of control lever units are operated, the hydraulic drive system further comprises a plurality of load pressure detecting lines for detecting respective load pressures of the plurality of actuators and a maximum load pressure detecting line for detecting maximum one of the load pressures detected by the plurality of load pressure detecting lines, bypass variable throttle means disposed in a bypass line branched from a hydraulic fluid supply line of the hydraulic pump and having a downstream end led to a reservoir, the bypass variable throttle means being operable to reduce an opening area thereof as the input amounts of the plurality of control lever units increase, thereby raising a delivery pressure of the hydraulic pump, a plurality of first pressure adjusting valves disposed respectively downstream of variable throttle portions of the plurality of directional control valves for controlling outlet pressures of the variable throttle portions to be kept substantially equal to the maximum load pressure detected by the maximum load pressure detecting line, and a second pressure adjusting valve disposed downstream of the bypass variable throttle means in the bypass line for controlling an outlet pressure of the bypass variable throttle means to be kept substantially equal to the maximum load pressure detected by the maximum load pressure detecting line.

In the hydraulic drive system according to the present invention constructed as set forth above, the bypass variable throttle means is disposed in the bypass line branched from the hydraulic fluid supply line of the hydraulic pump and having its downstream end led to the reservoir, and the opening area of the bypass variable throttle means is reduced to raise the delivery pressure of the hydraulic pump as the input amounts of the control lever units increase. Therefore, the bleed control is achieved even though the directional control valves of closed center type are employed.

Also, since the plurality of first pressure adjusting valves are disposed respectively downstream of the variable throttle portions of the plurality of directional control valves for controlling the outlet pressures of the variable throttle portions to be kept substantially equal to the maximum load pressure and the second pressure adjusting valve is disposed downstream of the bypass variable throttle means in the bypass line for controlling the outlet pressure of the bypass variable throttle means to be kept substantially equal to the maximum load pressure, the differential pressures across the variable throttle portions of the directional control valves and the differential pressure across the bypass variable throttle means are equal to each other, allowing the delivery rate of the hydraulic pump to be distributed in accordance with a ratio in opening area between the variable throttle portions of the directional control valves and the bypass variable throttle means. As a result, the inflow rates to the actuators depending on the strokes of the directional control valves are obtained in accordance with the ratio in opening area between the variable throttle portions of the directional control valves and the bypass variable throttle valve regardless of the load pressures. Thus, rising characteristics of the inflow rates (metering) to the actuators are held substantially fixed regardless of the load pressures.

In the above hydraulic drive system, preferably, the first pressure adjusting valves and the second pressure adjusting valve are each constructed such that a pressure upstream of the pressure adjusting valve acts in the valve-opening direction, the maximum load pressure acts in the valve-closing direction, and a spring force is applied in the valve-closing direction.

To achieve the above second object, according to the present invention, in the above hydraulic drive system, an on/off valve is disposed in at least one of the plurality of load pressure detecting lines for selectively making the load pressure of the associated actuator detected or not detected.

By so disposing the on/off valve in at least one of the plurality of load pressure detecting lines, when the on/off valve is closed to make the load pressure not detected, the load pressure of the associated actuator is not detected and the pressure detected by the maximum load pressure detecting line is a low reservoir pressure, for example, and hence the second pressure adjusting valve controls the outlet pressure of the bypass variable throttle means to be kept substantially equal to the reservoir pressure in the sole operation of the associated actuator. Accordingly, the delivery pressure of the hydraulic pump is raised upon a pressure drop depending on the opening area (restriction amount) of the bypass variable throttle means which is changed with the input amount of the control lever unit, and the delivery pressure of the hydraulic pump can be controlled depending on the input amount of the control lever unit, enabling a heavy load actuator to be operated with satisfactory maneuverability in delicate operation.

In the combined operation of plural actuators with the on/off valve opened to make the load pressure not detected, supposing that the actuator on the side including the on/off valve is a heavy load actuator and the actuator on the other side ia a light load actuator, the maximum load pressure detecting line detects the load pressure of the light load actuator as the maximum load pressure, and the first and second pressure adjusting valves control respectively the outlet pressures of the variable throttle portions of the directional control valves and the outlet pressure of the bypass variable throttle means to be substantially equal to the load pressure of the light load actuator, thus controlling the differential pressures across the variable throttle portions of the directional control valves and the differential pressure across the bypass variable throttle valve to be equal to each other. Therefore, when the pump delivery pressure is lower than the load pressure of the heavy load actuator, the delivery rate of the hydraulic pump is distributed in accordance with a ratio in opening area between the variable throttle portion of the directional control valve associated with the light load actuator and the bypass variable throttle means. When the delivery rate of the hydraulic pump is increased and the pump delivery pressure becomes higher than the load pressure of the heavy load actuator, the delivery rate of the hydraulic pump is distributed in accordance with a ratio in opening area between both the variable throttle portions of the directional control valves associated with the actuators and the bypass variable throttle means. In any case, the hydraulic fluid delivered from the pump is supplied to the light load actuator at a flow rate depending on the ratio in opening area. As a result, the pump delivery pressure will not rise to the relief pressure and the driving speed of the light load actuator can be prevented from reducing.

To achieve the above third object, according to the present invention, the above hydraulic drive system includes, as the aforesaid pump control means, pump control means for carrying out negative flow control so that a delivery rate of the hydraulic pump is increased corresponding to a reduction in flow rate downstream of the second pressure adjusting valve in the bypass line, or pump control means for carrying out positive flow control so that a delivery rate of the hydraulic pump is increased corresponding to an increase in command values from the plurality of control lever units.

The first and second pressure adjusting valves control the differential pressures across the variable throttle portions of the directional control valves and the differential pressure across the bypass variable throttle means to be equal to each other, as stated above, rather than keeping those differential pressures across to fixed as made by pressure compensating valves. In this connection, the pump control means does not control a differential pressure between the pump delivery pressure and the maximum load pressure to be maintained like the load-sensing control, but the delivery rate of the hydraulic pump is subjected to the negative flow control or the positive flow control as stated above. Therefore, when the pump delivery rate is increased or decreased by changing a set speed of a prime mover, the increased or decreased pump delivery rate is distributed in accordance with the ratio in opening area and the actuator inflow rate can be increased or decreased in response to an increase or decrease of the pump delivery rate depending on the set speed of the prime mover. Thus, a flow rate characteristic corresponding the stroke of the directional control valve is changed depending on the set speed of the prime mover. Consequently, even when the prime mover is set to a low speed, a fine control function capable of realizing the delicate operation is achieved.

In such a case, the pump control means for carrying out the negative flow control comprises, e.g., a tilting control device for controlling a tilting angle of the hydraulic pump under negative flow control, pressure generating means disposed downstream of the second pressure adjusting valve in the bypass line for generating a pressure corresponding to the flow rate of the hydraulic fluid passing through the bypass line, and a line for transmitting the pressure generated by the pressure generating means to the tilting control device.

Alternatively, the pump control means for carrying out the negative flow control may comprise a tilting control device for controlling a tilting angle of the hydraulic pump under negative flow control, a hydraulic source, a proportional solenoid valve for controlling a pressure of a hydraulic fluid from the hydraulic source and transmitting the controlled pressure to the tilting control device, pressure generating means disposed downstream of the second pressure adjusting valve in the bypass line for generating a pressure corresponding to the flow rate of the hydraulic fluid passing through the bypass line, a pressure sensor for detecting the pressure generated by the pressure generating means, and a controller for outputting a driving current to the proportional solenoid valve based on a signal from the pressure sensor and the input amounts by which the control lever units are operated.

Also, the pump control means for carrying out the positive flow control comprises, e.g., a tilting control device for controlling a tilting angle of the hydraulic pump under positive flow control, and a line for transmitting, to the tilting control device, one of load pressures produced by the control lever units that is applied to the bypass variable throttle means.

Alternatively, the pump control means for carrying out the positive flow control may comprise a tilting control device for controlling a tilting angle of the hydraulic pump under positive flow control, a hydraulic source, a proportional solenoid valve for controlling a pressure of a hydraulic fluid from the hydraulic source and transmitting the controlled pressure to the tilting control device, and a controller for outputting a driving current to the proportional solenoid valve based on the input amounts by which the control lever units are operated.

BEST MODE FOR CARRYING OUT THE INVENTION

Several embodiments of the present invention will be described hereunder with reference to the drawings.

A first embodiment of the present invention will be first described with reference to FIGS. 1 to 3. In this embodiment, the present invention is applied to a hydraulic drive system equipped with a pump tilting control device adapted for negative flow control.

Figure 1:
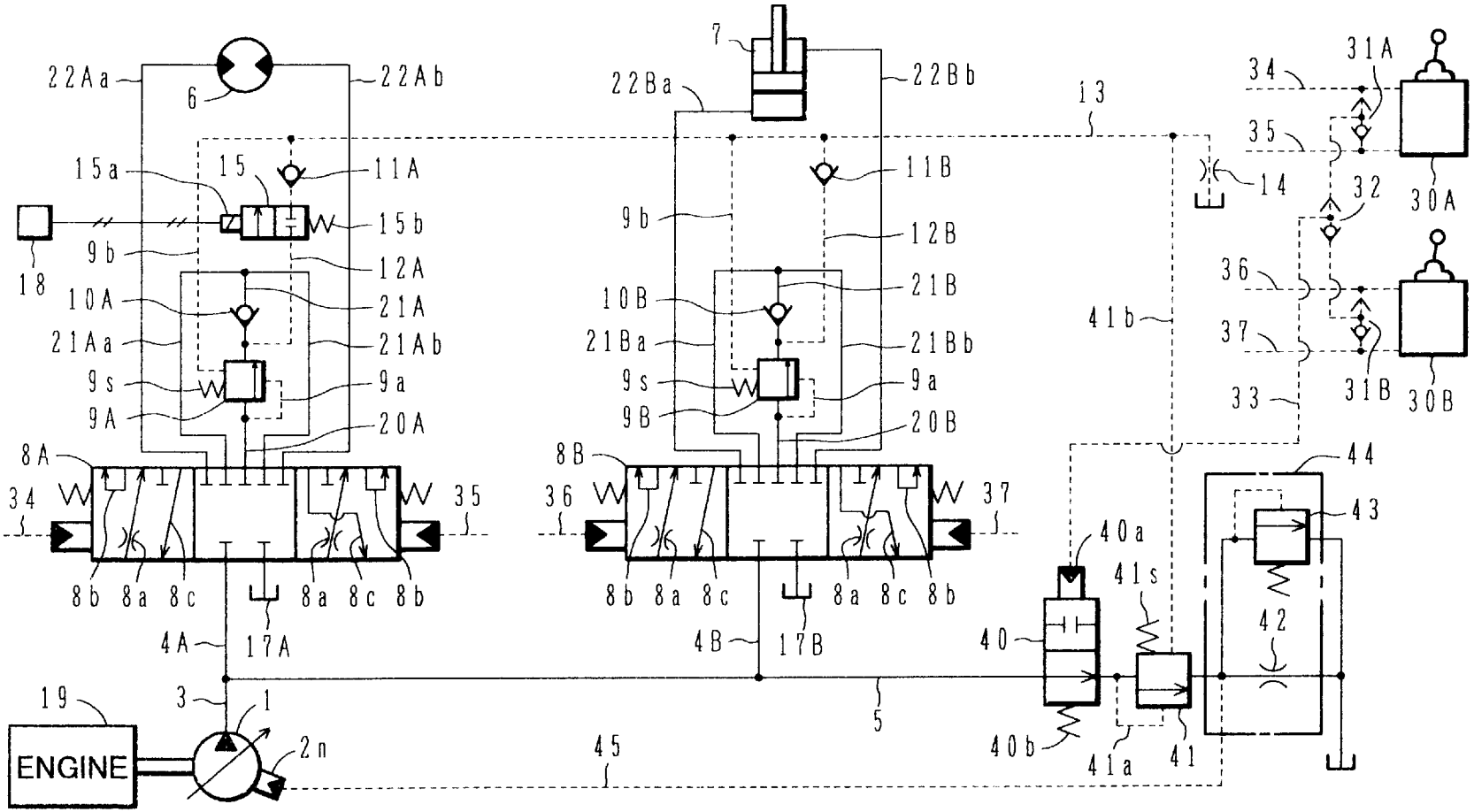
FIG. 1 is a hydraulic circuit diagram showing a hydraulic drive system according to a first embodiment of the present invention.
Figure 2:
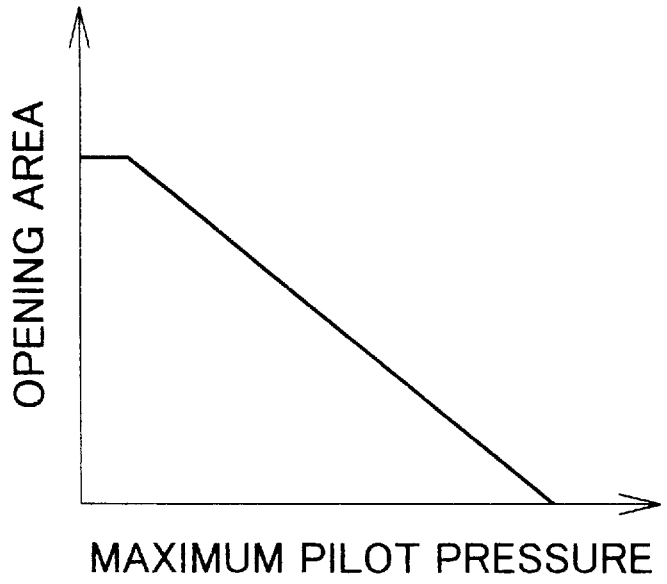
FIG. 2 is a graph showing an operating characteristic of a bypass variable throttle valve.

In FIG. 1, the hydraulic drive system of this embodiment comprises a variable displacement hydraulic pump 1 driven for rotation by an engine 19, actuators 6, 7 driven by a hydraulic fluid delivered from the hydraulic pump 1, directional control valves 8A, 8B of closed center type connected to the hydraulic pump 1 through a supply line 3 and parallel lines 4A, 4B for controlling flows of the hydraulic fluid supplied to the actuators 6, 7, and control lever units 30A, 30B for operating the directional control valves 8A, 8B, respectively.

A bypass line 5 leading to a reservoir is branched from the supply line 3 through which the hydraulic fluid delivered from the variable displacement pump 1 flows. In the bypass line 5, there are disposed a variable throttle valve 40 and a pressure adjusting valve 41 positioned downstream of the variable throttle valve 40. A pressure generator 44 comprising a throttle 42 and a relief valve 43 is disposed downstream of the variable throttle valve 40 and the pressure adjusting valve 41 which are disposed in the bypass line 5. A pressure generated by the pressure generator 44 is introduced to a tilting control device 2*n* of the pump 1 through a signal line 45. The tilting control device 2*n* is designed to carry out negative flow control for the delivery rate of the hydraulic pump 1 in such a manner that the pump delivery rate is decreased or increased in accordance with an increase or decrease of the pressure generated by the pressure generator 44 depending on an increase or decrease of the bypass flow rate through the variable throttle valve 40 and the pressure adjusting valve 41.

Connected to the directional control valve 8A are the parallel line 4A extended from the pump 1, an inflow line 20A leading to a pressure adjusting valve 9A, branch lines 21A*a*, 21A*b* connected to an inflow line 21A of a load check valve 10A downstream of the pressure adjusting valve 9A, and load lines 22A*a*, 22A*b* connected to the actuator 6. Also, the directional control valve 8A includes an inflow variable throttle portion 8*a*, a directional control portion 8*b* and an outflow portion 8*c* for directional control of the actuator 6.

The directional control valve 8B is constructed similarly and, in FIG. 1, the same components as those of the directional control valve 8A are denoted by the same reference numerals but affixed with B in place of A.

Further, lines 12A, 12B for detecting load pressures of the actuators 6, 7 are connected to lines upstream of the load check valves 10A, 10B, respectively. The load pressure detecting lines 12A, 12B are connected to a detecting line 13 so that a maximum load pressure is detected by the detecting line 13. A drain throttle 14 is connected to the detecting line 13.

Additionally, an on/off valve 15 is disposed in the load pressure detecting line 12A for the actuator 6.

The control lever units 30A, 30B are of hydraulic pilot type generating pilot pressures depending on input amounts by which respective control levers are operated. The generated pilot pressures are output to pilot lines 34, 36 or 35, 37 depending on the directions in which the control levers are operated, thus driving the directional control valves 8A, 8B to move depending on the input amounts of the control levers (i.e., demanded flow rates) and the operating directions of the control levers. The pilot pressures output to the pilot lines 34, 36 or 35, 37 are also introduced to a shuttle valve 32 through shuttle valves 31A, 31B, and a maximum pilot pressure is detected by a signal line 33.

The maximum load pressure is introduced to the pressure adjusting valves 9A, 9B through respective signal lines 9*b*, which are connected to the maximum load pressure detecting line 13, for urging the pressure adjusting valves 9A, 9B to close. Thus, the maximum load pressure gives a control force in the valve-closing direction along with weak springs 9*s* for holding the pressure adjusting valves 9A, 9B in their fully closed positions. Outlet pressures of the inflow variable throttle portions 8*a* of the directional control valves 8A, 8B are introduced to make open the pressure adjusting valves 9A, 9B through the inflow lines 20A, 20B and signal lines 9*a*, thereby providing control forces in the valve-opening direction. Accordingly, the pressure adjusting valves 9A, 9B control the outlet pressures of the inflow variable throttle portions 8*a* of the directional control valves 8A, 8B to be substantially equal to the maximum load pressure.

The variable throttle valve 40 disposed in the bypass line 5 has a pilot driving sector 40*a* operating in the throttling direction, and a spring 40*b* for holding the variable throttle valve 40 in its fully closed position. The maximum pilot pressure detected by the signal line 33 is applied to the pilot driving sector 40*a* for operating the variable throttle valve 40 to have an opening that is restricted to a larger extent as the control force provided by the maximum pilot pressure increases. More specifically, the variable throttle valve 40 has an opening characteristic set, as shown in FIG. 2, such that the variable throttle valve 40 is fully opened when the maximum pilot pressure is nil (0) or small, the opening area of the variable throttle valve 40 is gradually reduced as the maximum pilot pressure increases, and the opening area of the variable throttle valve 40 becomes nil (0), i.e., the variable throttle valve 40 is fully closed, when the maximum pilot pressure is maximized.

Introduced to the pressure adjusting valve 41 is the maximum load pressure through a signal line 41*b,* which is connected to the above-mentioned detecting line 13, for urging the pressure adjusting valve 41 to close. Thus, the maximum load pressure gives a control force in the valve-closing direction along with a weak spring 41*s* for holding the pressure adjusting valves 41 in its fully closed position. An outlet pressure of the variable throttle valve 40 is introduced to make open the pressure adjusting valve 41 through a signal line 41*a,* thereby providing a control force in the valve-opening direction. Accordingly, the pressure adjusting valve 41 controls the outlet pressure of the variable throttle valve 40 to be substantially equal to the maximum load pressure.

Figure 3:
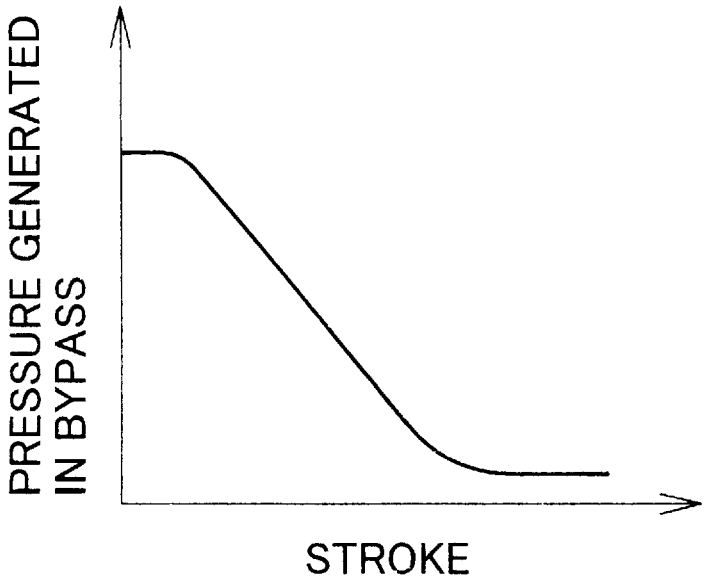
FIG. 3 is a graph showing a pressure generating characteristic of a pressure generator.
Figure 4:
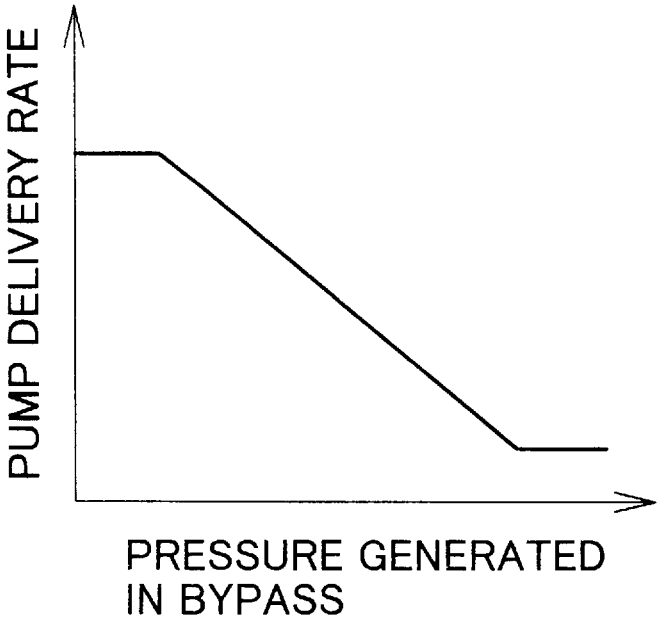
FIG. 4 is a graph showing a flow rate control characteristic of a tilting control device.
Figure 5:
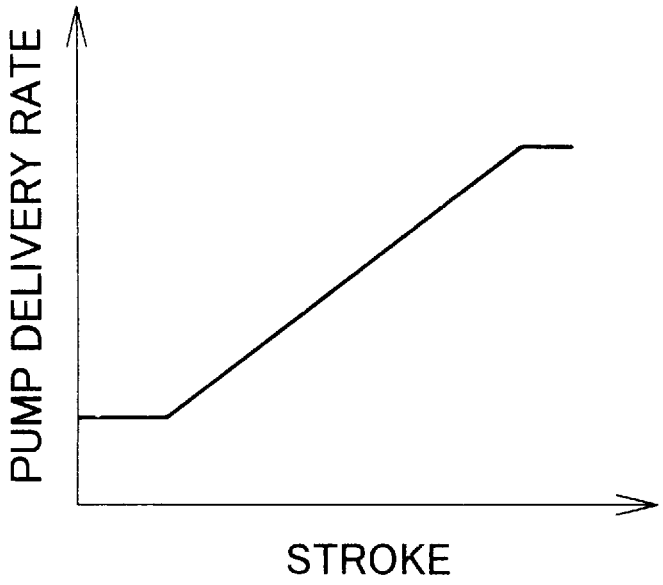
FIG. 5 is a graph showing a flow rate characteristic of a hydraulic pump.

FIG. 3 shows the relationship between the pressure generated by the pressure generator 44 and the stroke of the directional control valve 8A or 8B driven by the maximum pilot pressure as resulted when the variable throttle valve 40 is driven to move by the maximum pilot pressure as described above. The pressure generated by the pressure generator 44 is reduced as the stroke of the directional control valve increases. FIG. 4 shows a flow rate characteristic of the tilting control device 2*n* for the hydraulic pump 1 to perform the negative flow control. The delivery rate of the hydraulic pump 1 is increased as the pressure generated by the pressure generator 44 lowers. Accordingly, as shown in FIG. 5, the delivery rate of the hydraulic pump 1 is controlled to increase with an increase in the stroke of the directional control valve 8A or 8B, i.e., depending on the input amount of the control lever unit 30A or 30B. In other words, the pressure generator 44 in the bypass line 5, the signal line 45 and the tilting control device 2*n* constitute a pump control device for controlling the delivery rate of the hydraulic pump 1 so that the hydraulic pump 1 delivers the hydraulic fluid at a flow rate corresponding to the input amount of the control lever unit 30A, 30B.

The on/off valve 15 is a valve having an open position and a closed position. The on/off valve 15 includes a solenoid driving sector 15*a* operating the valve toward the open position, and a spring 15*b* urging the valve toward the closed position. When an electric signal is applied to the solenoid driving sector 15*a* from a mode changeover switch 18, the on/off valve 15 is switched over from the closed position to the open position, enabling the load pressure of the actuator 6 to be detected by the load pressure detecting line 12A.

The operation of this embodiment thus constructed will be described below.

For example, when both the control lever units 30A, 30B are not operated and the directional control valves 8A, 8B are in their neutral positions as shown, the variable throttle valve 40 in the bypass line 5 remains fully open. Since the maximum load pressure detecting line 13 is communicated with the reservoir through the drain throttle 14, the detecting line 13 is subjected to the reservoir pressure when the directional control valves 8A, 8B are in the neutral positions, and hence the pressure adjusting valve 41 is also fully opened with the reservoir pressure introduced to it through the line 41*b* connected to the maximum load pressure detecting line 13. Accordingly, all of the hydraulic fluid from the hydraulic pump 1 flows into the pressure generator 44 through the supply line 3, the bypass line 5, the bypass variable throttle valve 40 and the pressure adjusting valve 41. A resulted high pressure upstream of the throttle 42 is introduced to the tilting control device 2*n* through the signal line 45 to thereby reduce the pump delivery rate.

A description will now be made on the sole operation of one actuator in connection with the driving of the actuator 7.

When the control lever unit 30B is operated from the neutral condition stated above to produce a pilot pressure in the pilot line 36 or 37, the directional control valve 8B is shifted to the left or right as viewed on the drawing to increase the opening of the inflow variable throttle portion 8*a.* The pilot pressure is also introduced to the signal line 33 through the shuttle valves 31B, 32, whereupon the opening of the bypass variable throttle valve 40 starts to reduce. At the same time, the load pressure of the actuator 7 is detected by the maximum load pressure detecting line 13 through the load pressure detecting line 12B and the check valve 11B. The detected load pressure is introduced to the pressure adjusting valve 9B and the pressure adjusting valve 41 through the signal lines 9*b,* 41*b* connected to the maximum load pressure detecting line 13, thereby urging both the pressure adjusting valves to close. Then, the pressure adjusting valve 9B and the pressure adjusting valve 41 control respectively the outlet pressure of the inflow variable throttle portion 8*a* of the directional control valve 8B and the outlet pressure of the bypass variable throttle valve 40 to be substantially equal to the load pressure of the actuator 7. Here, the inlet pressure of the inflow variable throttle portion 8*a* of the directional control valve 8B and the inlet pressure of the bypass variable throttle valve 40 are the same, i.e., both equal to the delivery pressure of the hydraulic pump 1. As a result, the differential pressure across the inflow variable throttle portion 8*a* of the directional control valve 8B is equal to the differential pressure across the bypass variable throttle valve 40, and the delivery rate of the hydraulic pump 1 is distributed to an inflow rate to the actuator 7 and a bypass flow rate to the bypass line 5 in accordance with a ratio in opening area between the inflow variable throttle portion 8*a* of the directional control valve 8B and the bypass variable throttle valve 40.

Thus, since the hydraulic fluid is supplied to the actuator 7 with the delivery pressure of the hydraulic pump 1 raised while a part of the delivery rate of the hydraulic pump 1 is returned to the reservoir through the bypass line 5, the bleed control is achieved even though the directional control valve 8B of closed center type is employed.

Figure 6:
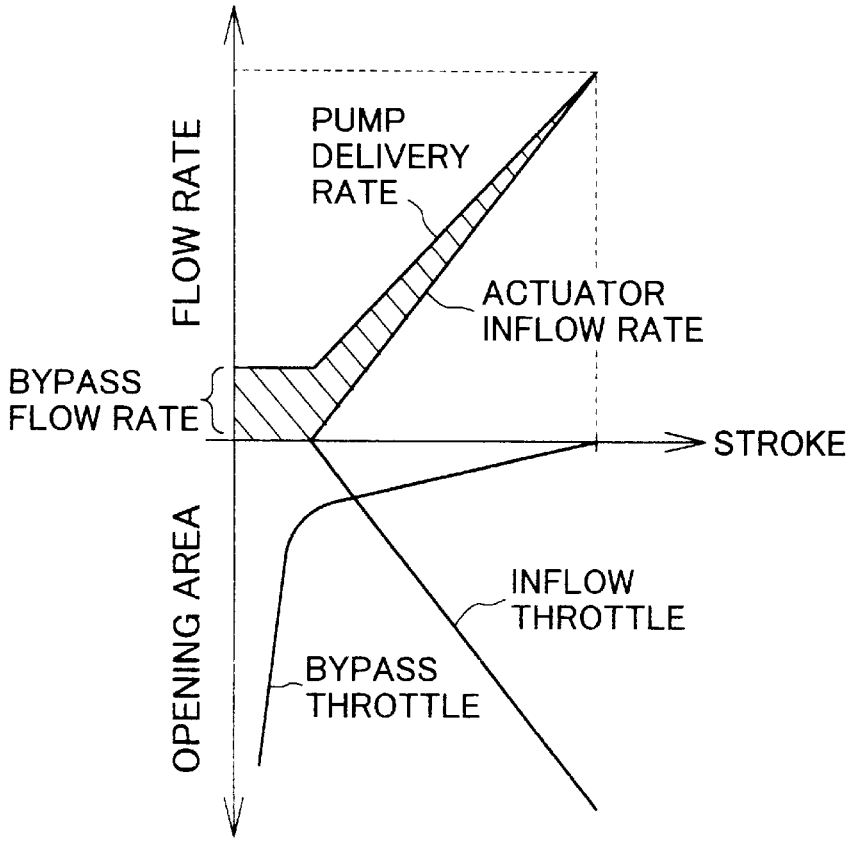
FIG. 6 is a graph showing operating characteristics of the embodiment shown in FIG. 1.

If the load pressure of the actuator 7, for example, is increased in the foregoing condition, the increased load pressure introduced from the maximum load pressure detecting line 13 through the signal line 41*b* acts on the pressure adjusting valve 41 in the valve-closing direction so that, corresponding to the increased load pressure, the opening of the pressure adjusting valve 41 is restricted to reduce the flow rate of the hydraulic fluid passing through the bypass line 5. Therefore, the signal pressure generated by the throttle 42 of the pressure generator 44 lowers depending on such a reduction in the bypass flow rate. Then, corresponding to a lowering of the signal pressure introduced through the signal line 45, the tilting control device 2*n* increases the delivery rate of the hydraulic pump 1 through the negative flow control. The increased pump delivery rate is distributed again to the actuator inflow rate and the bypass flow rate in accordance with the ratio in opening area between the inflow variable throttle portion 8*a* of the directional control valve 8B and the bypass variable throttle valve 40. Accordingly, as shown in a characteristic graph of FIG. 6, the inflow rate (metering) to the actuator 7 depending on the stroke of the directional control valve 8B is obtained in accordance with the ratio in opening area between the inflow variable throttle portion 8*a* of the directional control valve 8B and the bypass variable throttle valve 40 regardless of the load pressure. Thus, a rising characteristic of the inflow rate to the actuator 7 is held fixed regardless of the load pressure.

A description will now be made on the driving of the actuator 6.

When the control lever unit 30A is operated from the shown neutral condition to produce a pilot pressure in the pilot line 34 or 35, the directional control valve 8A is shifted to the left or right as viewed on the drawing to increase the opening of the inflow variable throttle portion 8*a*. The pilot pressure is also introduced to the signal line 33 through the shuttle valves 31A, 32, whereupon the opening of the bypass variable throttle valve 40 starts to reduce. At this time, if the operator does not manipulate the mode changeover switch 18 and the on/off valve 15 disposed in the load pressure detecting line 12A is in the closed position, the load pressure of the actuator 6 is blocked by the on/off valve 15 and not detected by the detecting line 12A, and the pressure detected by the maximum load pressure detecting line 13 is the reservoir pressure as with the neutral condition. In this case, the pressure adjusting valve 41 in the bypass line 5 is fully opened with no restriction of the opening. Accordingly, the delivery pressure of the hydraulic pump 1 is raised upon a pressure drop depending on the opening area (restriction amount) of the bypass variable throttle valve 40 which is changed with the pilot pressure, and the delivery rate of the hydraulic pump 1 is subjected to the negative flow control depending on the pressure generated by the pressure generator 44 due to the bypass flow rate. In this case, therefore, the bleed control is also achieved even though the directional control valve 8A of closed center type is employed. In addition, the delivery pressure of the hydraulic pump 1 can be controlled depending on the input amount of the control lever unit 30A (i.e., the pilot pressure). As a result, when the actuator 6 is employed as a swing motor of a hydraulic excavator, the swing motor having a great inertial load can be driven with satisfactory maneuverability in delicate operation.

A description will now be made on the combined operation of the actuators 6 and 7.

When the control lever units 30A, 30B are operated from the shown neutral condition to produce respectively a pilot pressure in the pilot line 34 or 35 and a pilot pressure in the pilot line 36 or 37, the directional control valves 8A, 8B are each shifted to the left or right as viewed on the drawing to increase the opening of the inflow variable throttle portion 8*a*. The pilot pressures are also introduced to the shuttle valve 32 through the shuttle valves 31A, 31B and the detected maximum pilot pressure is introduced to the signal line 33, whereupon the opening of the bypass variable throttle valve 40 starts to reduce. At this time, if the operator does not manipulate the mode changeover switch 18 and the on/off valve 15 disposed in the load pressure detecting line 12A is in the closed position, the maximum load pressure detected by the maximum load pressure detecting line 13 is the load pressure on the side of the actuator 7. Therefore, the load pressure of the actuator 7 is introduced to the pressure adjusting valves 9A, 9B and the pressure adjusting valve 41 through the signal lines 9*b*, 9*b*, 41*b* connected to the maximum load pressure detecting line 13, thereby urging those pressure adjusting valves to close. Then, the pressure adjusting valves 9A, 9B and the pressure adjusting valve 41 control respectively the outlet pressures of the inflow variable throttle portions 8*a* of the directional control valves 8A, 8B and the outlet pressure of the bypass variable throttle valve 40 to be substantially equal to the load pressure of the actuator 7. As a result, the differential pressures across the inflow variable throttle portions 8*a*, 8*a* of the directional control valves 8A, 8B and the differential pressure across the bypass variable throttle valve 40 are equal to each other. Also, the delivery rate of the hydraulic pump 1 is subjected to the negative flow control depending on the pressure generated by the pressure generator 44 due to the flow rate through the bypass line 5. Therefore, when the pump delivery pressure is lower than the load pressure of the actuator 6, the delivery rate of the hydraulic pump 1 is distributed to the actuator inflow rate and the bypass flow rate in accordance with a ratio in opening area between the inflow variable throttle portion 8*a* of the directional control valve 8B associated with the actuator 7 and the bypass variable throttle valve 40. When the delivery rate of the hydraulic pump 1 is increased and the pump delivery pressure becomes higher than the load pressure of the actuator 6, the delivery rate of the hydraulic pump 1 is distributed to the actuator inflow rate and the bypass flow rate in accordance with a ratio in opening area between the inflow variable throttle portions 8*a*, 8*a* of the directional control valves 8A, 8B associated with the actuators 6, 7 and the bypass variable throttle valve 40. In any case, the hydraulic fluid delivered from the pump 1 is supplied to the actuator 7 at a flow rate depending on the ratio in opening area. Accordingly, supposing that the actuator 6 is used to turn an upper structure and the actuator 7 is used to operate a boom in a hydraulic excavator, the pressure adjusting valve 41 in the bypass line 5 and the pressure adjusting valves 9A, 9B are operated on the basis of the load pressure of the boom actuator 7 on the smaller load side during the combined operation of the upper structure and the boom, i.e., turning and boom-up. As a result, the delivery pressure of the hydraulic pump 1 will not rise to the relief pressure, a sufficient boom speed can be ensured, and the operator can smoothly perform loading work according to his intention.

Also, when a driving pressure to speed up the upper structure is required, e.g., in the case of turning the upper structure on a slope or in loading work with the upper structure turned through a large angle, the operator manipulates the mode changeover switch 18 to shift the on/off valve 15 disposed in the load pressure detecting line 12A for the actuator 6 into the open position. This enables the load pressure detecting line 12A to detect the load pressure of the actuator 6. Therefore, the load pressure of the actuator 6 is detected by the maximum load pressure detecting line 13 and then introduced to the pressure adjusting valve 41 in the bypass line 5 and the pressure adjusting valves 9A, 9B for operating the valves. Consequently, it is possible to ensure a high pump delivery pressure and achieve a further improvement in maneuverability and working efficiency.

Furthermore, in the hydraulic drive system of this embodiment, the delivery rate of the hydraulic pump 1 is distributed to the actuator inflow rate and the bypass flow rate in accordance with a ratio in opening area between the inflow variable throttle portions 8*a*, 8*a* of the directional control valves 8A, 8B and the bypass variable throttle valve 40 by controlling the differential pressures across the inflow variable throttle portions 8*a*, 8*a* of the directional control valves 8A, 8B and the differential pressure across the bypass variable throttle valve 40 to be equal to each other, rather than controlling the differential pressures across the inflow variable throttle portions 8*a*, 8*a* of the directional control valves 8A, 8B and the differential pressure across the bypass variable throttle valve 40 to be kept fixed as made in the case of using pressure compensating valves. As to the delivery rate of the hydraulic pump 1, it is controlled by the pressure generator 44 and the tilting control device 2*n* to increase depending on the input amount of the control lever unit 30A, 30B unlike the so-called load sensing control under which the pump delivery rate is controlled to maintain a certain differential pressure between the pump delivery pressure and the maximum load pressure. Therefore, when the pump delivery rate is increased or decreased by changing a set speed of the engine 19, the increased or decreased pump delivery rate is distributed in accordance with the ratio in opening area and the actuator inflow rate can be increased or decreased in response to an increase or decrease of the pump delivery rate depending on the set speed of the engine 19. Specifically, a flow rate characteristic corresponding the stroke of the directional control valve 8A, 8B is changed depending on the set speed of the engine 19 as indicated by lines F1 to F3 in FIG. 7. Even when the engine 19 is set to a low speed as indicated by the line F3, a fine control function capable of realizing the delicate operation is achieved.

Figure 7:
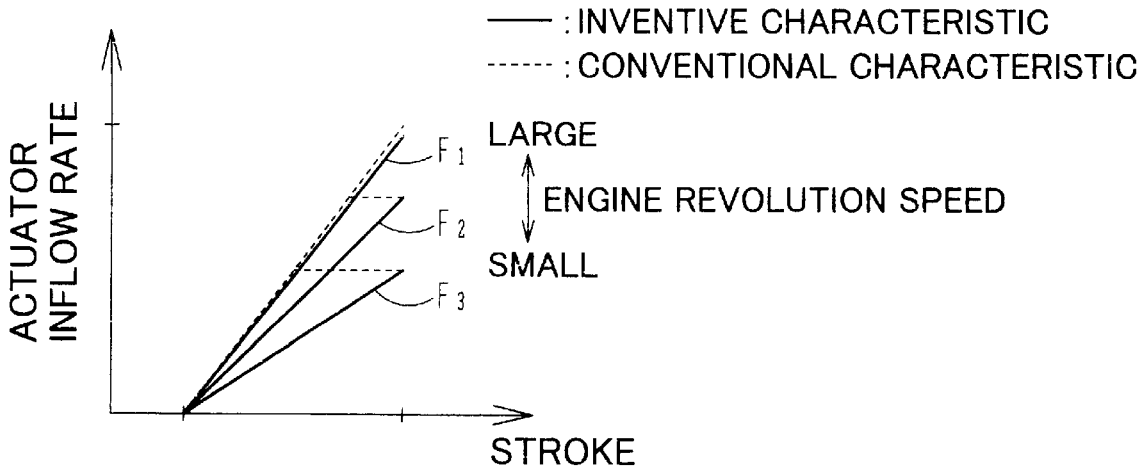
FIG. 7 is a graph showing operating characteristics of the embodiment shown in FIG. 1.

Meanwhile, when the pump delivery rate is controlled so as to ensure a certain differential pressure between the pump delivery pressure and the maximum load pressure like the load-sensing control, the actuator speed cannot be changed even with the set speed of the engine 19 changed, as indicated by a dot line in FIG. 7, because the differential pressures across the inflow variable throttle portions 8*a,* 8*a* of the directional control valves 8A, 8B are kept fixed. Further, the inflow rate to the actuator is saturated at a lower value as the revolution speed of the engine 19 reduces. Accordingly, an effective stroke range responsible to a command from the operator is narrowed and the fine control function intended by the operator cannot be achieved.

With this embodiment, as described above, the bleed control is achieved in a circuit using the directional control valves 8A, 8B of closed center type and a satisfactory operation feeling is obtained with not shock applied to the actuator. This embodiment can also provide a load-responsive hydraulic drive system in which a rising characteristic of the inflow rate (metering) to the actuator depending on the stroke of the inflow variable throttle portion 8*a,* 8*a* of the directional control valve 8A, 8B can be held fixed regardless of the load pressure and an operation feeling is not changed even with an increase or decrease of the load. Further, by closing the on/off valve 15 to make the load pressure of the actuator 6 not detected, the pump delivery pressure can be controlled to improve maneuverability in the delicate operation when the actuator 6 is allocated to a heavy load and driven solely. In addition, during the combined operation of the actuators 6, 7, the pump delivery pressure will not rise to the relief pressure, and it is possible to prevent quick speed-up of the heavy load actuator 6 and a reduction in the driving speed of the light load actuator 7.

Moreover, the inflow rate to the actuator 6, 7 can be increased or decreased depending on the revolution speed of the engine 19, and a satisfactory fine control function can be achieved.

Figure 8:
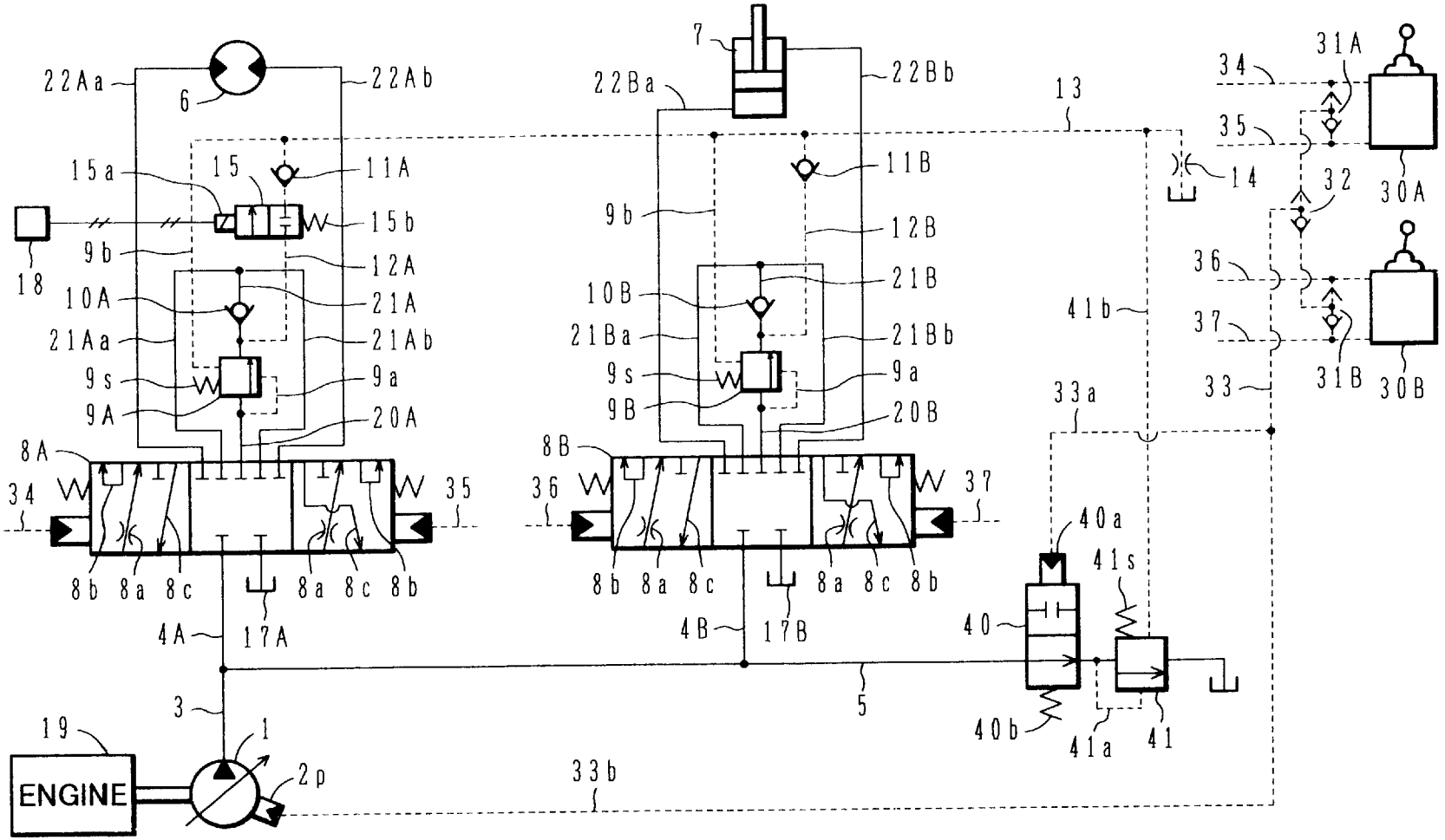
FIG. 8 is a hydraulic circuit diagram showing a hydraulic drive system according to a second embodiment of the present invention.

A second embodiment of the present invention will be described with reference to FIG. 8. In this embodiment, the present invention is applied to a hydraulic drive system equipped with a pump tilting control device adapted for positive flow control. In FIG. 8, equivalent members to those in FIG. 1 are denoted by the same reference numerals.

Figure 9:
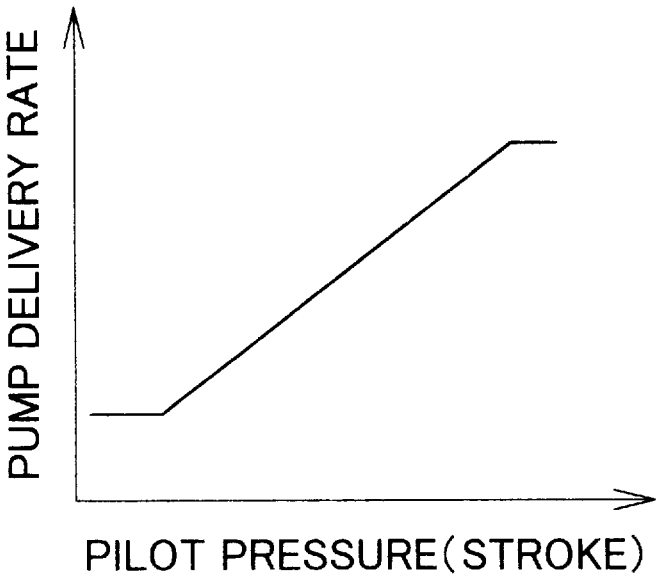
FIG. 9 is a graph showing a flow rate characteristic of a hydraulic pump.

Referring to FIG. 8, the hydraulic pump 1 is provided with a tilting control device 2*p* having a positive flow control characteristic as shown in FIG. 9. Therefore, the pressure generator 44 (comprising the throttle 42 and the relief valve 43) disposed in the most downstream portion of the bypass line 5 for the negative flow control in the above first embodiment is omitted, and the maximum pilot pressure produced by the control lever unit 30A, 30B is introduced to the pilot driving sector 40*a* of the variable throttle valve 40 in the bypass line 5 and the tilting control device 2*p* through respective signal lines 33*a,* 33*b*.

In this embodiment thus constructed, when both the control lever units 30A, 30B are not operated and the directional control valves 8A, 8B are in their neutral positions as shown, the pressure adjusting valve 41 is fully opened because the line 41*b* extended from the pressure adjusting valve 41 is communicated with the reservoir through the drain throttle 14 in the maximum load pressure detecting line 13. Accordingly, all of the hydraulic fluid from the hydraulic pump 1 flows into the reservoir through the supply line 3, the bypass line 5, the bypass variable throttle valve 40 and the pressure adjusting valve 41. Further, with no pilot pressures introduced to the pilot line 34 or 35 and the pilot line 36 or 37, the pump delivery rate is reduced under the positive flow control by the tilting control device 2*p* connected to the pilot lines through the shuttle valve 32 and the signal lines 33, 33*b*.

When the control lever unit 30B is operated to shift the directional control valve 8B associated with the actuator 7 to the left or right as viewed on the drawing, a corresponding pilot pressure is introduced to the line 33*b* through the shuttle valves 31, 32 and the signal line 33 and, based on the introduced signal pressure (pilot pressure), the tilting control device 2*p* carries out the positive flow control to increase the delivery rate of the hydraulic pump 1. At the same time, the signal pressure (pilot pressure) introduced to the line 33*a* reduces the opening of the bypass variable throttle valve 40 and also starts to increase the opening of the inflow variable throttle portion 8*a* of the directional control valve 8B. Further, the load pressure of the actuator 7 is detected to the maximum load pressure detecting line 13 through the load pressure detecting line 12 and the check valve 11B. The detected maximum load pressure is introduced to the pressure adjusting valve 9B and the pressure adjusting valve 41 through the signal lines 9*b,* 41*b* connected to the detecting line 13, urging both the pressure adjusting valves to close. Then, the pressure adjusting valve 9B and the pressure adjusting valve 41 control respectively the outlet pressure of the inflow variable throttle portion 8*a* of the directional control valve 8B and the outlet pressure of the bypass variable throttle valve 40 to be substantially equal to the detected load pressure. Accordingly, the delivery rate of the hydraulic pump 1 is distributed to an inflow rate to the actuator 7 and a bypass flow rate to the bypass line 5 in accordance with a ratio in opening area between the inflow variable throttle portion 8*a* of the directional control valve 8B and the bypass variable throttle valve 40. As a result, similar advantages as with the first embodiment are obtained.

In the sole operation of the actuator 6 and the combined operation of the actuators 6 and 7, since the on/off valve 15 is disposed in the load pressure detecting line 12A and the load pressure of the actuator 6 is selectively detected by the detecting line 13 similarly to the first embodiment, the pressure adjusting valve 41 in the bypass line 5 can be held fully open or operated in accordance with a lower load pressure. In these cases, therefore, similar advantages as with the first embodiment are also obtained.

Moreover, in the hydraulic drive system of this embodiment using the positive flow control, the delivery rate of the hydraulic pump 1 controlled depending on the input amount of the control lever unit 30A, 30B is distributed to the actuator inflow rate and the bypass flow rate in accordance with the ratio in opening area, a fine control function capable of realizing the delicate operation is achieved even when the engine 19 is set to a low speed, as with the first embodiment.

Figure 10:
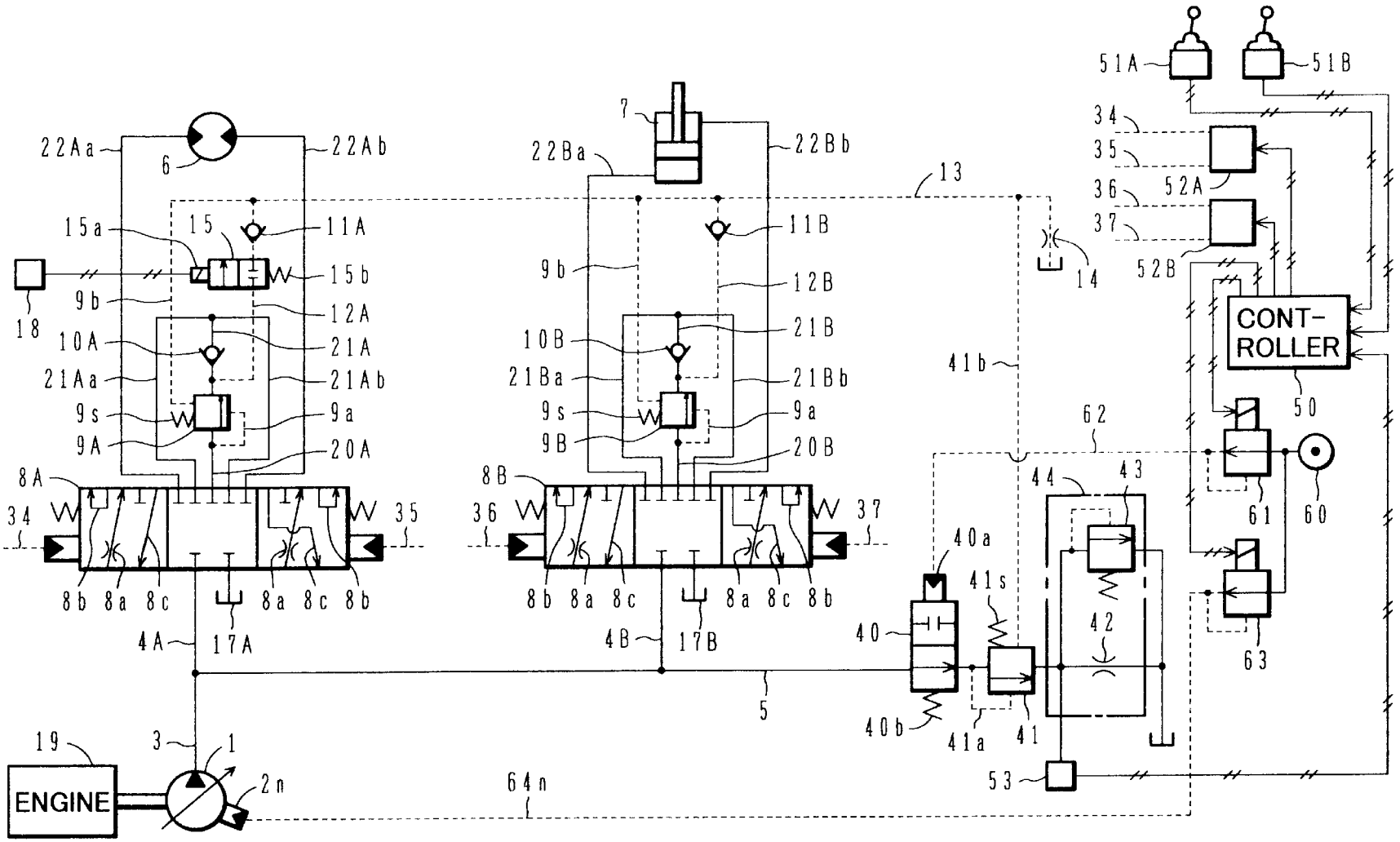
FIG. 10 is a hydraulic circuit diagram showing a hydraulic drive system according to a third embodiment of the present invention.

A third embodiment of the present invention will be described with reference to FIGS. 10 to 12. In this embodiment, the present invention is applied to a hydraulic drive system operated under negative flow control in a manner of electronic control. In FIG. 10, equivalent members to those in FIG. 1 are denoted by the same reference numerals.

Referring to FIG. 10, operating sections for driving the directional control valves 8A, 8B comprise electric control lever units 51A, 51B, a controller 50, and pilot pressure generators 52A, 52B. Respective pilot pressures corresponding to input commands from the control lever units 51A, 51B are output to the pilot line 34 or 35 and the pilot line 36 or 37.

Proportional solenoid valves 61, 63 controlled by the controller 50 are connected to a hydraulic source 60. The proportional solenoid valve 61 is connected to the pilot driving sector 40*a* of the variable throttle valve 40 in the bypass line 5 through a signal line 62 for driving the variable throttle valve 40, and the proportional solenoid valve 63 is connected to the tilting control device 2*n* through a signal line 64*n* for driving the tilting control device 2*n*.

The pressure generator 44 comprising the throttle 42 and the relief valve 43 is disposed downstream of the variable throttle valve 40 and the pressure adjusting valve 41 in the bypass line 5 as with the first embodiment shown in FIG. 1. The pressure generated by the pressure generator 44 is detected by the controller 50 through a pressure sensor 53.

Figure 11:
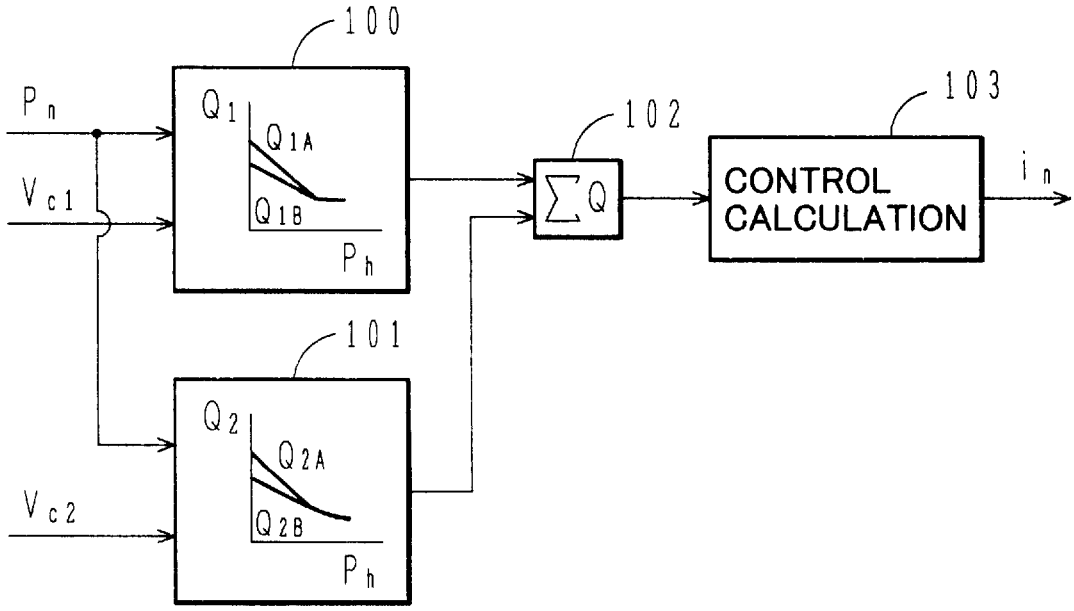
FIG. 11 is a block diagram showing control functions executed by a controller for pump control.

The negative flow control of the hydraulic pump 1 by the controller 50 is executed, by way of example, as shown in FIG. 11. Based on input amounts Vc1, Vc2 of the electric control lever units 51A, 51B and a detected value P of the pressure sensor 53, respective demanded flow rates of the actuators 6, 7 are determined (blocks 100, 101). A driving current for the proportional solenoid valve 63 corresponding to the pilot pressure which is necessary for providing a target pump tilting amount corresponding to a total of the demanded flow rates (block 102) is calculated for control (block 103), the current being then output to the proportional solenoid valve 63.

Figure 12:
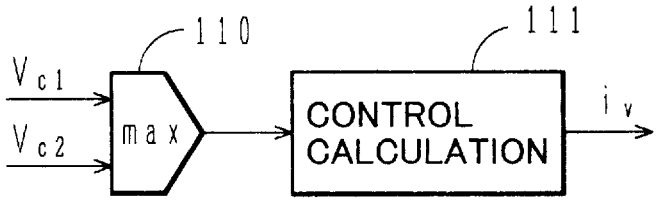
FIG. 12 is a block diagram showing control functions executed by the controller for the bypass variable throttle valve.

The bypass variable throttle valve 40 is controlled, by way of example, as shown in FIG. 12. A maximum value of the input amounts Vc1, Vc2 of the electric control lever units 51A, 51B is determined (block 110), and a driving current for the proportional solenoid valve 61 corresponding to the pilot pressure representative of the determined maximum value is calculated for control (block 111), the current being then output to the proportional solenoid valve 61.

In this embodiment thus constructed, the directional control valves 8A, 8B are controlled to shift by the pilot pressures output from the pilot devices 52A, 52B depending on the input amounts of the electric control lever units 51A, 51B, and the bypass variable throttle valve 40 and the tilting control device 2*n* are controlled through the controller 50 and the proportional solenoid valves 61, 63. Therefore, similar advantages as with the first embodiment shown in FIG. 1 are obtained in a hydraulic drive system operated under negative flow control in a manner of electronic control. Also, since the controller 50 is provided which can calculate a demanded flow rate for each of the actuators based on a command from the control lever unit and can set a pump target value for the negative flow control, the hydraulic drive system is adaptable for a variety of operation patterns, i.e., various work forms.

Figure 13:
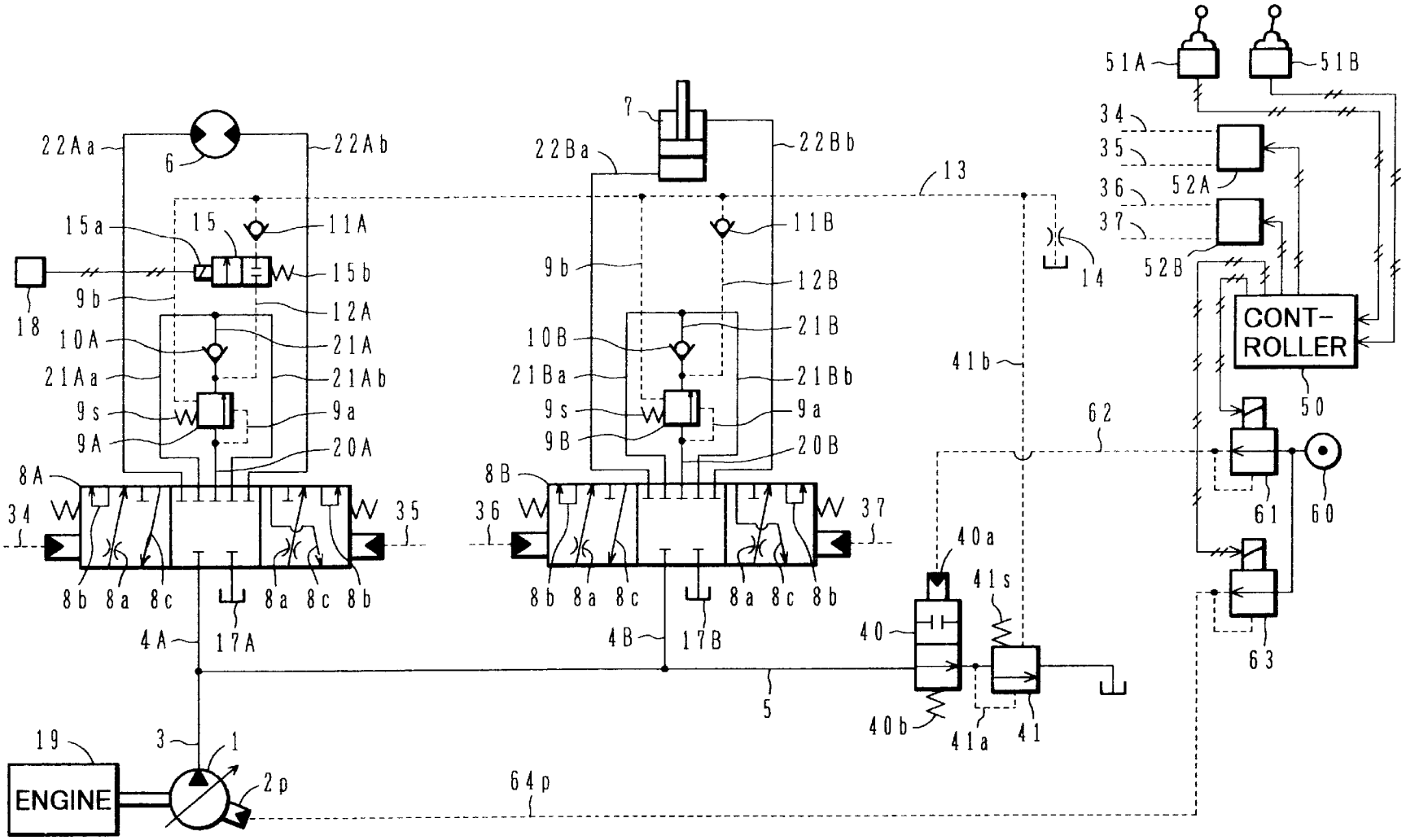
FIG. 13 is a hydraulic circuit diagram showing a hydraulic drive system according to a fourth embodiment of the present invention.

A fourth embodiment of the present invention will be described with reference to FIGS. 13 and 14, as well as FIG. 12 referred above. In this embodiment, the present invention is applied to a hydraulic drive system operated under positive flow control in a manner of electronic control. In FIG. 13, equivalent members to those in FIGS. 1, 8 and 10 are denoted by the same reference numerals.

Referring to FIG. 13, the hydraulic pump 1 is provided with the tilting control device 2*p* adapted for positive flow control. Therefore, the pressure generator 44 (comprising the throttle 42 and the relief valve 43) disposed in the most downstream portion of the bypass line 5 and the pressure sensor 53, shown in FIG. 10, for the negative flow control are omitted, and the proportional solenoid valve 63 connected to the controller 50 is in turn connected to the tilting control device 2*p* through a signal line 64*p* for operating it.

Figure 14:
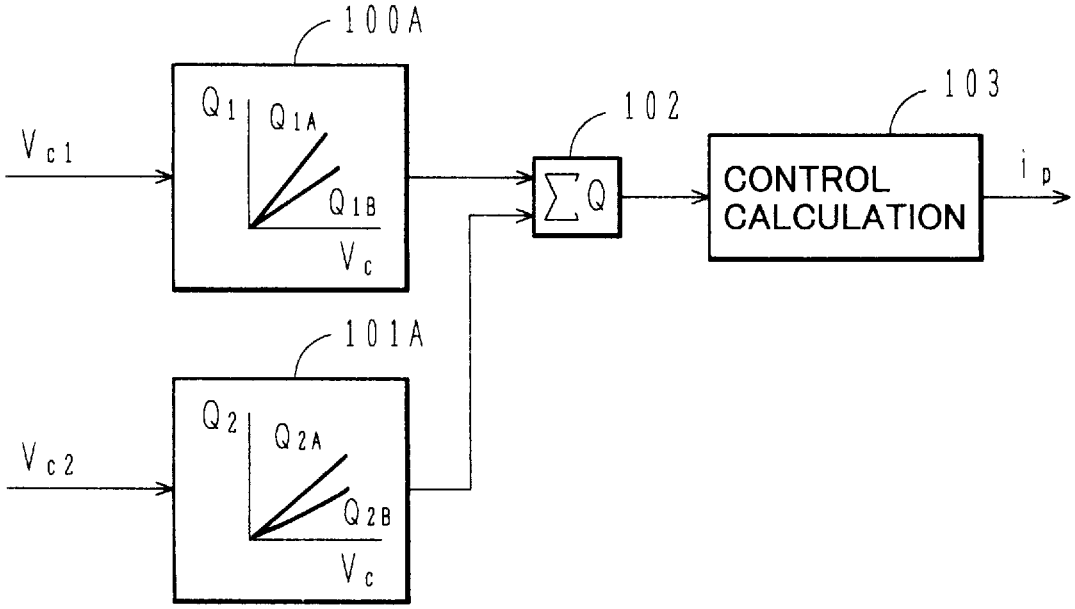
FIG. 14 is a block diagram showing control functions executed by a controller for pump control.
Figure 15:
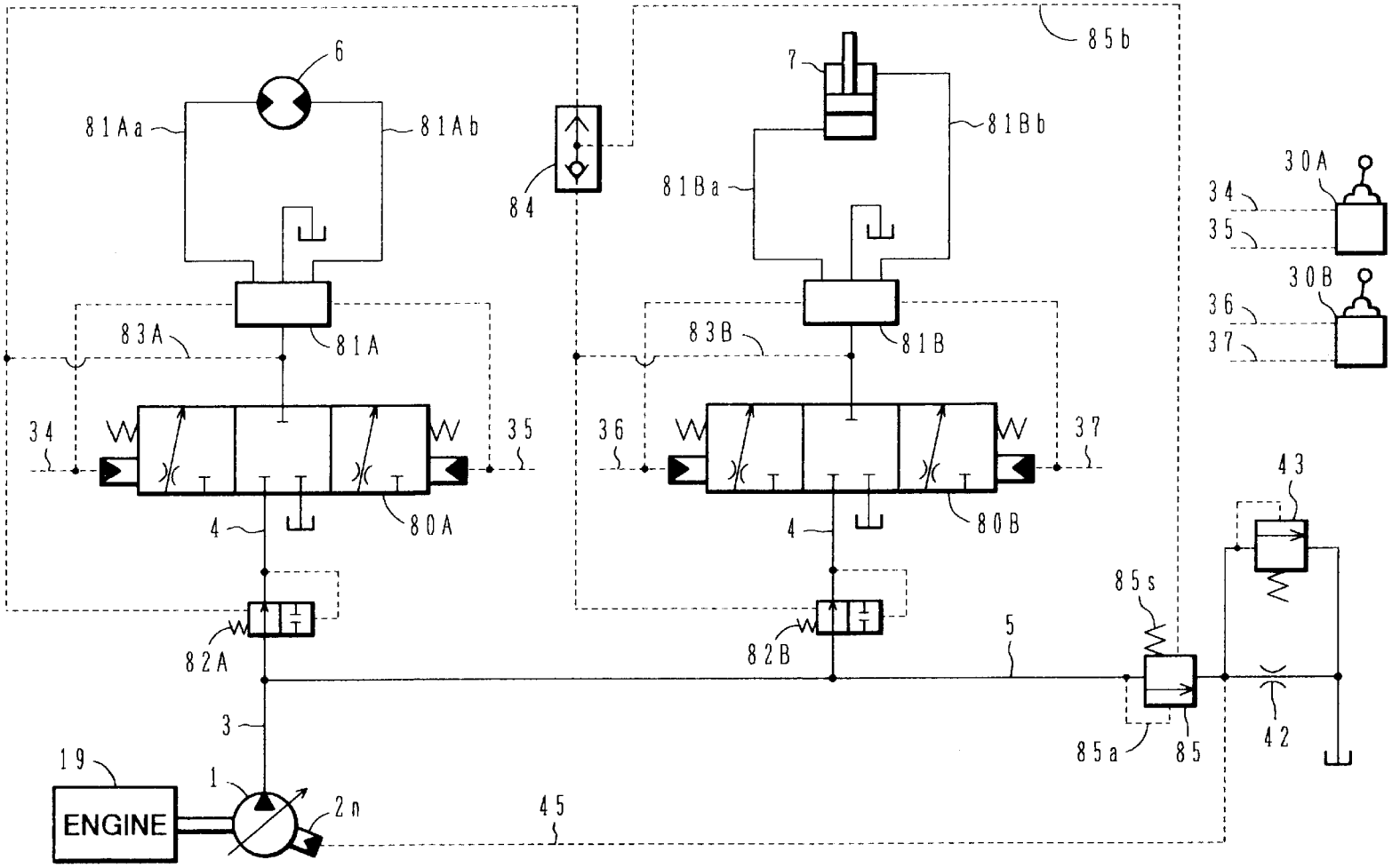
FIG.15 RELATED ART
FIG. 15 is a hydraulic circuit diagram showing a conventional hydraulic drive system.

The positive flow control of the hydraulic pump 1 by the controller 50 is executed, by way of example, as shown in FIG. 14. Based on the input amounts Vc1, Vc2 of the electric control lever units 51A, 51B, respective demanded flow rates of the actuators 6, 7 are determined (blocks 100A, 101A). A driving current for the proportional solenoid valve 63 corresponding to the pilot pressure which is necessary for providing a target pump tilting amount corresponding to a total of the demanded flow rates (block 102) is calculated for control (block 103), the current being then output to the proportional solenoid valve 63.

In this embodiment thus constructed, the directional control valves 8A, 8B are controlled to shift by the pilot pressures output from the pilot devices 52A, 52B depending on the input amounts of the electric control lever units, and the bypass variable throttle valve 40 and the tilting control device 2*p* are controlled through the controller 50 and the proportional solenoid valves 61, 63. Therefore, similar advantages as with the second embodiment shown in FIG. 8 are obtained in a hydraulic drive system operated under positive flow control in a manner of electronic control. Also, since the controller 50 is provided which can calculate a demanded flow rate for each of the actuators based on a command from the control lever unit and can set a pump target value for the positive flow control, the hydraulic drive system is adaptable for various work forms.

INDUSTRIAL APPLICABILITY

As will be apparent from the foregoing description, according to the hydraulic drive system of the present invention, bleed control can be performed in a circuit using directional control valves of closed center type, and a satisfactory operation feeling can be obtained with not shock applied to any actuator. There can also be provided a load-responsive hydraulic drive system in which a rising characteristic of the inflow rate to the actuator depending on the stroke of the inflow variable throttle portion of the directional control valve can be held fixed regardless of the load pressure and an operation feeling is not changed even with an increase or decrease of the load.

Further, by closing the on/off valve to make the load pressure not detected, the pump delivery pressure can be controlled to improve maneuverability in the delicate operation when the associated actuator is driven solely. In addition, during the combined operation of the plural actuators, the pump delivery pressure will not rise to the relief pressure, and it is possible to prevent quick speed-up of the heavy load actuator and a reduction in the driving speed of the light load actuator.

Moreover, the actuator inflow rate can be increased or decreased depending on a revolution speed of a prime mover, a good fine control function can be achieved.

We claim:

1. A hydraulic drive system comprising a variable displacement hydraulic pump (1), a plurality of actuators (6, 7) driven by a hydraulic fluid delivered from said hydraulic pump (1), a plurality of directional control valves (8A, 8B) of closed center type connected to said hydraulic pump (1) through hydraulic fluid supply lines (22A, 22B) for controlling flows of the hydraulic fluid supplied to said plurality of actuators (6, 7), a plurality of control lever units (30A, 30B) for operating said plurality of directional control valves, and pump control means (2*n;* 2*p*) for controlling a delivery rate of said hydraulic pump (1) to become a flow rate corresponding to input amounts by which said plurality of control lever units (30A, 30B) are operated, wherein said hydraulic drive system further comprises:

a plurality of load pressure detecting lines (12A, 12B) for detecting respective load pressures of said plurality of actuators (6, 7), and a maximum load pressure detecting line (13) for detecting maximum one of the load pressures detected by said plurality of load pressure detecting lines (12A, 12B), bypass variable throttle means (40) disposed in a bypass line (5) branched from a hydraulic fluid supply line (3) of said hydraulic pump (1) and having a downstream end led to a reservoir, said bypass variable throttle means (40) being operable to reduce an opening area thereof as the input amounts of said plurality of control lever units (30A, 30B) increase, thereby raising a delivery pressure of said hydraulic pump, a plurality of first pressure adjusting valves (9A, 9B) disposed respectively downstream of variable throttle portions (8*a,* 8*b*) of said plurality of directional control valves (8A, 8B) for controlling outlet pressures of said variable throttle portions (8*a,* 8*b*) to be kept substantially equal to the maximum load pressure detected by said maximum load pressure detecting line (13), and a second pressure adjusting valve (41) disposed downstream of said bypass variable throttle means (40) in said bypass line (5) for controlling an outlet pressure of said bypass variable throttle means (40) to be kept substantially equal to the maximum load pressure detected by said maximum load pressure detecting line (13).

2. A hydraulic drive system according to claim 1, wherein said first pressure adjusting valves (9A, 9B) and said second pressure adjusting valve (41) are each constructed such that a pressure upstream of said pressure adjusting valve acts in the valve-opening direction, said maximum load pressure acts in the valve-closing direction, and a spring force is applied in the valve-closing direction.

3. A hydraulic drive system comprising a variable displacement hydraulic pump (1), a plurality of actuators (6, 7) driven by a hydraulic fluid delivered from said hydraulic pump (1), a plurality of directional control valves (8A, 8B) of closed center type connected to said hydraulic pump (1) through hydraulic fluid supply lines (22A, 22B) for controlling flows of the hydraulic fluid supplied to said plurality of actuators (6, 7), a plurality of control lever units (30A, 30B) for operating said plurality of directional control valves, and pump control means (2*n;* 2*p*) for controlling a delivery rate of said hydraulic pump (1) to become a flow rate corresponding to input amounts by which said plurality of control lever units (30A, 30B) are operated, wherein said hydraulic drive system further comprises:

a plurality of load pressure detecting lines (12A, 12B) for detecting respective load pressures of said plurality of actuators (6, 7), and a maximum load pressure detecting line (13) for detecting maximum one of the load pressures detected by said plurality of load pressure detecting lines (12A, 12B), bypass variable throttle means (40) disposed in a bypass line (5) branched from a hydraulic fluid supply line (3) of said hydraulic pump (1) and having a downstream end led to a reservoir, said bypass variable throttle means (40) being operable to reduce an opening area thereof as the input amounts of said plurality of control lever units (30A, 30B) increase, thereby raising a delivery pressure of said hydraulic pump, a plurality of first pressure adjusting valves (9A, 9B) disposed respectively downstream of variable throttle portions (8*a,* 8*b*) of said plurality of directional control valves (8A, 8B) for controlling outlet pressures of said variable throttle portions (8*a,* 8*b*) to be kept substantially equal to the maximum load pressure detected by said maximum load pressure detecting line (13), a second pressure adjusting valve (41) disposed downstream of said bypass variable throttle means (40) in said bypass line (5) for controlling an outlet pressure of said bypass variable throttle means (40) to be kept substantially equal to the maximum load pressure detected by said maximum load pressure detecting line (13), and, an on/off valve (15) disposed in at least one of said plurality of load pressure detecting lines (12A, 12B) for selectively making the load pressure of the associated actuator (6) detected or not detected.

4. A hydraulic drive system according to claim 3, wherein said first pressure adjusting valves (9A, 9B) and said second pressure adjusting valve (41) are each constructed such that a pressure upstream of said pressure adjusting valve acts in the valve-opening direction, said maximum load pressure acts in the valve-closing direction, and a spring force is applied in the valve-closing direction.

5. A hydraulic drive system according to claim 3, wherein said plurality of actuators include a first actuator (6) for driving a heavy load and a second actuator (7) for driving a load smaller than the load driven by said first actuator, and said on/off valve (15) is disposed in said load pressure detecting line (12A) associated with said first actuator (6).

6. A hydraulic drive system comprising a variable displacement hydraulic pump (1), a plurality of actuators (6, 7) driven by a hydraulic fluid delivered from said hydraulic pump (1), a plurality of directional control valves (8A, 8B) of closed center type connected to said hydraulic pump (1) through hydraulic fluid supply lines (22A, 22B) for controlling flows of the hydraulic fluid supplied to said plurality of actuators (6, 7), and a plurality of control lever units (30A, 30B) for operating said plurality of directional control valves, wherein said hydraulic drive system further comprises:

a plurality of load pressure detecting lines (12A, 12B) for detecting respective load pressures of said plurality of actuators (6, 7), and a maximum load pressure detecting line (13) for detecting maximum one of the load pressures detected by said plurality of load pressure detecting lines (12A, 12B), bypass variable throttle means (40) disposed in a bypass line (5) branched from a hydraulic fluid supply line (3) of said hydraulic pump (1) and having a downstream end led to a reservoir, said bypass variable throttle means (40) operating to reduce an opening area thereof as input amounts by which said plurality of control lever units (30A, 30B) are operated increase, thereby raising a delivery pressure of said hydraulic pump, a plurality of first pressure adjusting valves (9A, 9B) disposed respectively downstream of variable throttle portions (8*a,* 8*b*) of said plurality of directional control valves (8A, 8B) for controlling outlet pressures of said variable throttle portions (8*a,* 8*b*) to be kept substantially equal to the maximum load pressure detected by said maximum load pressure detecting line (13), and a second pressure adjusting valve (41) disposed downstream of said bypass variable throttle means (40) in said bypass line (5) for controlling an outlet pressure of said bypass variable throttle means (40) to be kept substantially equal to the maximum load pressure detected by said maximum load pressure detecting line (13), and pump control means (2*n*) for carrying out negative flow control so that a delivery rate of said hydraulic pump (1) is increased corresponding to a reduction in flow rate downstream of said second pressure adjusting valve (41) in said bypass line (5).

7. A hydraulic drive system according to claim 6, wherein said first pressure adjusting valves (9A, 9B) and said second pressure adjusting valve (41) are each constructed such that a pressure upstream of said pressure adjusting valve acts in the valve-opening direction, said maximum load pressure acts in the valve-closing direction, and a spring force is applied in the valve-closing direction.

8. A hydraulic drive system according to claim 6, wherein said pump control means comprises a tilting control device (2*n*) for controlling a tilting angle of said hydraulic pump (1) under negative flow control, pressure generating means (44) disposed downstream of said second pressure adjusting valve (41) in said bypass line (5) for generating a pressure corresponding to the flow rate of the hydraulic fluid passing through said bypass line (5), and a line (45) for transmitting the pressure generated by said pressure generating means (44) to said tilting control device (2*n*).

9. A hydraulic drive system according to claim 6, wherein said pump control means comprises a tilting control device (2*n*) for controlling a tilting angle of said hydraulic pump (1) under negative flow control, a hydraulic source (60), a proportional solenoid valve (63) for controlling a pressure of a hydraulic fluid from said hydraulic source (60) and transmitting the controlled pressure to said tilting control device (2*n*), pressure generating means (44) disposed downstream of said second pressure adjusting valve (41) in said bypass line (5) for generating a pressure corresponding to the flow rate of the hydraulic fluid passing through said bypass line (5), a pressure sensor (53) for detecting the pressure generated by said pressure generating means (44), and a controller (50) for outputting a driving current to said proportional solenoid valve (63) based on a signal from said pressure sensor (53) and the input amounts by which said control lever units (51A, 51B) are operated.

10. A hydraulic drive system according to claim 6, further comprising an on/off valve (15) disposed in at least one of said plurality of load pressure detecting lines (12A, 12B) for selectively making the load pressure of the associated actuator (6) detected or not detected.

11. A hydraulic drive system according to claim 10, wherein said plurality of actuators include a first actuator (6) for driving a heavy load and a second actuator (7) for driving a load smaller than the load driven by said first actuator, and said on/off valve (15) is disposed in said load pressure detecting line (12A) associated with said first actuator (6).

12. A hydraulic drive system comprising a variable displacement hydraulic pump (1), a plurality of actuators (6, 7) driven by a hydraulic fluid delivered from said hydraulic pump (1), a plurality of directional control valves (8A, 8B) of closed center type connected to said hydraulic pump (1) through hydraulic fluid supply lines (22A, 22B) for controlling flows of the hydraulic fluid supplied to said plurality of actuators (6, 7), and a plurality of control lever units (30A, 30B) for operating said plurality of directional control valves, wherein said hydraulic drive system further comprises:

a plurality of load pressure detecting lines (12A, 12B) for detecting respective load pressures of said plurality of actuators (6, 7), and a maximum load pressure detecting line (13) for detecting maximum one of the load pressures detected by said plurality of load pressure detecting lines (12A, 12B), bypass variable throttle means (40) disposed in a bypass line (5) branched from a hydraulic fluid supply line (3) of said hydraulic pump (1) and having a downstream end led to a reservoir, said bypass variable throttle means (40) operating to reduce an opening area thereof as input amounts by which said plurality of control lever units (30A, 30B) are operated increase, thereby raising a delivery pressure of said hydraulic pump, a plurality of first pressure adjusting valves (9A, 9B) disposed respectively downstream of variable throttle portions (8*a,* 8*b*) of said plurality of directional control valves (8A, 8B) for controlling outlet pressures of said variable throttle portions (8*a,* 8*b*) to be kept substantially equal to the maximum load pressure detected by said maximum load pressure detecting line (13), and a second pressure adjusting valve (41) disposed downstream of said bypass variable throttle means (40) in said bypass line (5) for controlling an outlet pressure of said bypass variable throttle means (40) to be kept substantially equal to the maximum load pressure detected by said maximum load pressure detecting line (13), and pump control means (2*p*) for carrying out positive flow control so that a delivery rate of said hydraulic pump (1) is increased corresponding to an increase in command values from said plurality of control lever units (30A, 30B).

13. A hydraulic drive system according to claim 12, wherein said pump control means comprises a tilting control device (2*p*) for controlling a tilting angle of said hydraulic pump (1) under positive flow control, and a line (33*b*) for transmitting, to said tilting control device (2*p*), one of load pressures produced by said control lever units (30A, 30B) that is applied to said bypass variable throttle means (40).

14. A hydraulic drive system according to claim 12, wherein said pump control means comprises a tilting control device (2*p*) for controlling a tilting angle of said hydraulic pump (1) under positive flow control, a hydraulic source (60), a proportional solenoid valve (63) for controlling a pressure of a hydraulic fluid from said hydraulic source (60) and transmitting the controlled pressure to said tilting control device (2*p*), and a controller (50) for outputting a driving current to said proportional solenoid valve (63) based on the input amounts by which said control lever units (51A, 51B) are operated.

15. A hydraulic drive system according to claim 12, further comprising an on/off valve (15) disposed in at least one of said plurality of load pressure detecting lines (12A, 12B) for selectively making the load pressure of the associated actuator (6) detected or not detected.

16. A hydraulic drive system according to claim 12, further comprising an on/off valve (15) disposed in at least one of said plurality of load pressure detecting lines (12A, 12B) for selectively making the load pressure of the associated actuator (6) detected or not detected.

* * * * *